United States Patent [19]

Esparza

[11] 4,002,491

[45] Jan. 11, 1977

[54] REMOVAL OF COATINGS BY ROTATING CHAIN FLAILS

[75] Inventor: Jose O. Esparza, Houston, Tex.

[73] Assignee: Shell Oil Company, Houston, Tex.

[22] Filed: Aug. 25, 1975

[21] Appl. No.: 607,395

[52] U.S. Cl. ..... 134/6; 15/4; 15/88; 15/91; 29/81 E; 29/81 F

[51] Int. Cl.[2] ..... B08B 1/04

[58] Field of Search ..... 134/6; 29/81 E, 81 F, 29/81 H, 81 L; 15/88, 91, 104.04, 4; 427/290, 444; 51/5 R, 323

[56] References Cited

UNITED STATES PATENTS

| | | | |
|---|---|---|---|
| 2,064,577 | 12/1936 | Thayer | 15/88 |
| 2,104,062 | 1/1938 | Temple | 29/81 E |
| 2,319,985 | 5/1943 | Genasci | 15/91 |
| 2,427,129 | 9/1947 | Fields | 15/88 |
| 2,960,706 | 11/1960 | Dunham | 15/104.04 X |
| 3,343,986 | 9/1967 | Howery et al. | 134/6 |

FOREIGN PATENTS OR APPLICATIONS

| | | | |
|---|---|---|---|
| 613,890 | 12/1948 | United Kingdom | 29/81 E |

*Primary Examiner*—S. Leon Bashore
*Assistant Examiner*—Richard V. Fisher

[57] ABSTRACT

Coatings are loosened for removal from various substrates by rotating a chain-like flail against the coating while maintaining the flail oriented and positioned with respect to the surface of the coating so that the next-to-last terminal link of the flail barely strikes the coating on the edge of the link, twists and then whips the terminal link flat against the coating on the side of the link. The flail is useful for remote controlled operations as underwater or in a hazardous area as high radiation environment and may be employed for cleaning any underwater surface such as conduits, ships hulls, docks, and offshore drilling or production structures. In particular, the flail works well on underwater conduits when used in combination with a wire wheel brush which removes the coating from the conduit after the coating is first loosened by the flail.

12 Claims, 4 Drawing Figures

REMOVAL OF COATINGS BY ROTATING CHAIN FLAILS

BACKGROUND OF THE INVENTION

Coatings and other surface materials are often difficult to remove from conduits and other substrates, and there has been ample activity in the art directed to such problems, viz. U.S. Pat. Nos. 2,181,306; 2,631,315; 3,343,986; 3,495,288; and 3,820,184. In the case of thin film plastic coatings on conduits, particular epoxy coatings, removal is next to impossible due to the high adherence between the epoxy and conduit and the glass-smooth outer surface which prevents penetration by many removal methods. Such conduits are frequency damaged by vigorous removal techniques necessary to remove such materials. In the case of underwater conduits, problems are multiplied many times over. In the underwater environment, machines of the prior art generally are not adaptable for use. Removal of underwater coatings by divers is slow and expensive and the work is difficult both because of the underwater medium and the adhesive qualities of the coating. Bringing the conduit to the surface for removal of the coating is difficult, slow and expensive and abandonment of the conduit is costly and possibly hazardous. Nonetheless, the necessity for re-coating a conduit because of leakage, corrosion, etc. and for removal of the old coating to insure binding of the new coating or provide a reliable sealing surface frequently justifies such high expense. The present invention is directed to providing a new, less expensive, and more efficient technique, for accomplishing these desired results.

SUMMARY OF THE INVENTION

The primary purpose of this invention resides in removing coatings from substrates, the substrates being either underwater or elsewhere.

The above purpose has been achieved by a means of a unique flail which is positioned and oriented with respect to the coating surface so that the underlying substrate is not significantly damaged by the removal action.

More specifically, in accordance with the invention, there is provided an apparatus for removing a coating from a substrate comprising at least one chain-like flail, means for rotating the flail into contact with the coating, the flail being oriented and positioned with respect to the coating surface so that the next-to-last terminal link of the flail will barely strike the coating on the edge of the link, twist and then whip the terminal link flat against the coating on the side of the link.

Even further, there is provided a method for removing a coating from a substrate comprising rotating a chain-like flail against the coating while maintaining the flail oriented and positioned with respect to the coating surface so that the next-to-last terminal link of the flail barely strikes the coating on the edge of the link, twists and then whips the terminal link flat against the coating on the side of the link.

Within the framework of the above described apparatus and method, the present invention not only solves the above mentioned problems of the prior art, but also achieves further significant advantages.

DESCRIPTION OF PREFERRED EMBODIMENTS

Figure 1:
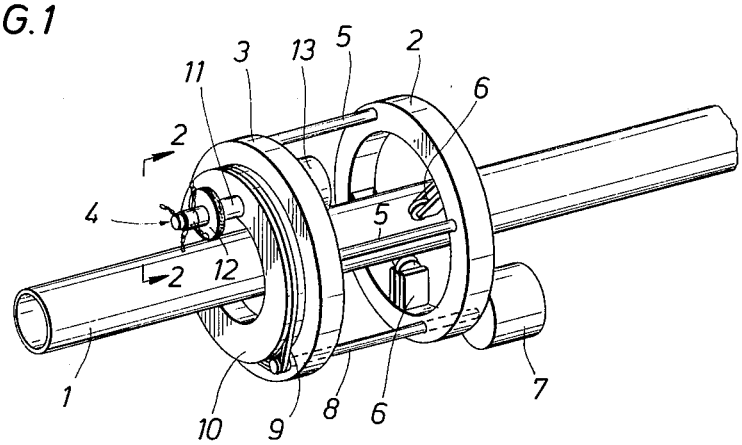
FIG. 1 is a perspective view of the flail and associated apparatus for moving the flail about and along a conduit.

FIG. 1 discloses the flail of the present invention and associated apparatus for moving the flail along and about a conduit. While a conduit is shown as the preferred embodiment, it is nevertheless understood that this invention is also useful for cleaning any underwater surface such as ships hulls, docks, and offshore drilling or production structures. This invention is particularly useful not only for remote controlled operations such as underwater but also in a hazardous area such as a high radiation environment.

In accordance with the preferred embodiment, conduit 1 is encircled by rings 2 and 3 which function to orient and position flail 4 with respect to the conduit. Bracing bars 5 position rings 2 and 3 with respect to each other. Ring 2 is centered about the wheels 6, and ring 3 is similarly centered by wheels not shown. Motor 7 or other drive means is connected by shaft 8 to pulley 9, which in turn drives the flail mounting support 10, to which flail 4 is connected by an axle 11 on which flail 4 and wire wheel brush 12 are mounted. Motor 13 or other drive means rotates axle 11.

Figure 2:
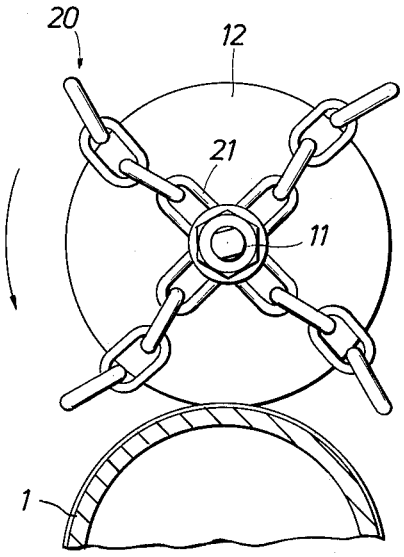
FIGS. 2–4 are side views of the flail.
Figure 3:
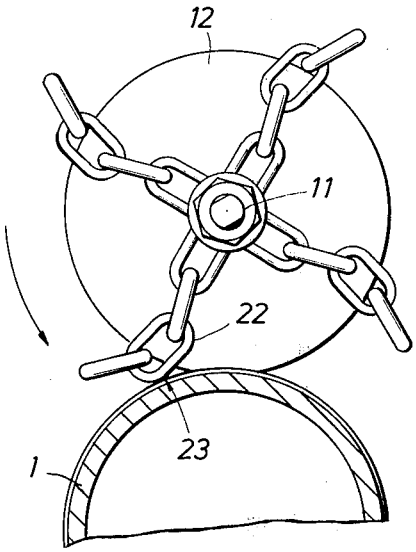
Figure 4:
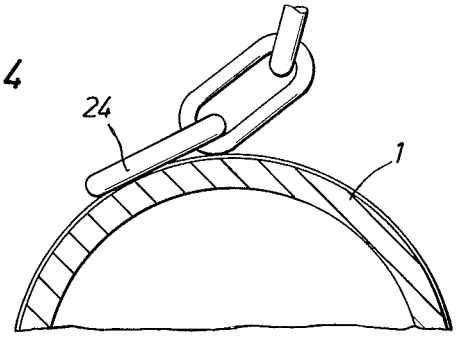

FIGS. 2–4 show the action of the chain-like flail when striking the conduit. Flail 4 is composed of one or more chains 20, comprised of individual links such as next-to-axle link 21. Directly behind the chains is wire wheel brush 12. As the axle 11 turns the chains 20, the next-to-terminal link 22 strikes conduit 1 on the edge 23 of the link. Thus, the full mass of the link does not impact upon the conduit but most of the mass of the link carries past the conduit as shown in FIG. 4, without full impact. As the next-to-terminal link 22 strikes the conduit, it twists and brings the full mass of terminal link 24 flat against the conduit. Inasmuch as the mass of the terminal link is distributed over a maximum surface, damage to the conduit is minimized. This compares with the case where the terminal link hits the conduit edgewise with substantial dents resulting. Such dents eventually lead to a poor subsequent coating upon the conduit and may cause increased corrosion and eventual failure of the conduit.

Various types of chain-like flails have been found useful with the present invention and it will be understood that the invention is subject to some latitude in the specifications of the flail. The most successful flail for loosening thin film epoxy coatings was a 9/32 inch chain, heat treated throughout to 150,000 psi tensile strength, 35 RC hardness, four sets of four links each 9¼ , inches in diameter over the extended chain, each set having one link welded to a hub at 90° points around the hub circumference such that the flat side of the welded link lies in a plane perpendicular to the hub axis in FIG. 3. Experimentally, it was found that effective rotary speed of the chain hub was from about 700 rpm to about 1100 rpm, the maximum speed available from the equipment in use. The pipe being cleaned was rotated under the rotary cleaner from about 6 to about 10 rpm. The pipe was transversed at rates from about 1 inch to about 6 inches per minute.

A wide variety of abrasive means have been found useful with the present invention. Particularly effective are radial wire brushes, both open and elastomer bonded, to finish cleaning to bare metal after initial cleaning with the chains.

The present invention is useful on numerous types of coatings, and the rotary chain cleaner has been used very successfully in removing baked epoxy coating 0.020 inches thick and mastic-aggregate mix coating 0.75 inches thick (SOMASTIC).

Various drive means may be employed for operating the different parts of the above-described apparatus. A hydraulic motor provides suitable variable speed drive for the underwater cleaning and is preferred.

The present invention is useful not only in water but elsewhere. Thus, when going from water to air, for example, the size, weight, and speed of the rotary impactors are adjusted to compensate for the fluid resistance change. Thereby, the coatings are removed without excessive surface damage on the substrate surface.

I claim as my invention:

1. An apparatus for removing a coating from a substrate without significantly damaging the substrate comprising several chain-like flails, means for rotating the flails into contact with the coating, and means for orienting and positioning all of the flails with respect to the coating surface so that the next-to-last terminal link of every flail will barely strike the coating on the edge of the link, twist and then whip the terminal link flat against the coating on the side of the link.

2. The apparatus of claim 1 wherein each flail is a 4 link 9/32 inch coil chain of about 35 RC.

3. The apparatus of claim 1 wherein the substrate is an underwater conduit and the rotating means includes a rotatable axle disposed parallel to the underwater conduit and means for rotating the axle upon its own axis as well as about the conduit.

4. The apparatus of claim 1 including abrasion means adjacent the flails and in contact with the coating.

5. An apparatus for removing a coating from an underwater substrate without significantly damaging the substrate comprising:

a rotatable axle disposed parallel to the substrate and means for rotating the axle;

several chain-like flails, each attached at one end to the axle and means for orienting and positioning all of the flails with respect to the coating surface so that upon rotation of the axle the next-to-last terminal link of each flail will barely strike the coating on the edge of the link, twist and then whip the terminal link flat against the coating on the side of the link; and abrasion means operable by the rotatable axle, adjacent the flails and in contact with the coating.

6. The apparatus of claim 5 wherein each flail is a 4 link 9/32 inch coil chain of about 35 RC.

7. The apparatus of claim 5 including means for rotating the axle upon its own axis as well as about the substrate which is a conduit.

8. An apparatus for removing a thin film coating from an underwater conduit without significantly damaging the conduit comprising:

a rotatable axle disposed parallel to the conduit and means for rotating the axle upon its own axis as well as about the conduit;

several chain flails attached to the axle and means for orienting and positioning all the flails with respect to the conduit so that upon rotation of the axle the next-to-last terminal link of each flail will barely strike the conduit on the edge of the link, twist and then whip the terminal link flat against the conduit on the side of the link, each of the chains being a 4 link 9/32 inch coil chain of about 35 RC; and an abrasion wheel operable by the rotatable axle, adjacent the flails and in contact with the conduit.

9. A method for removing a coating from a substrate without significantly damaging the substrate comprising rotating several chain-like flails against the coating while maintaining each flail oriented and positioned with respect to the coating surface so that the next-to-last terminal link of each flail barely strikes the coating on the edge of the link, twists and then whips the terminal link flat against the coating on the side of the link.

10. The method of claim 9 wherein the substrate is an underwater conduit.

11. The method of claim 10 wherein each flail is attached to and rotated by a rotatable axle which is rotated upon its own axis and also about the conduit.

12. The method of claim 11 wherein an abrasion wheel is attached to the rotatable axle, adjacent the flails and in contact with the conduit, and the flails and abrasion wheel are moved laterally down the conduit so that the coating is first loosened by the flails and then subsequently removed from the conduit by the abrasion wheel.

* * * * *